US011761240B2

(12) United States Patent
Zhang et al.

(10) Patent No.: US 11,761,240 B2
(45) Date of Patent: Sep. 19, 2023

(54) SAFETY LOCK DEVICE

(71) Applicant: Ningbo Eudemon Child Protective Equipment Co., Ltd., Zhjiang (CN)

(72) Inventors: Zhen Zhang, Zhejiang (CN); YingFeng Chen, Zhejiang (CN)

(73) Assignee: Ningbo Eudemon Child Protective Equipment Co., Ltd., Zhjiang (CN)

( * ) Notice: Subject to any disclaimer, the term of this patent is extended or adjusted under 35 U.S.C. 154(b) by 248 days.

(21) Appl. No.: 17/039,611

(22) Filed: Sep. 30, 2020

(65) Prior Publication Data

US 2022/0018158 A1 Jan. 20, 2022

(30) Foreign Application Priority Data

Jul. 15, 2020 (CN) ..... 202010680126.3

(51) Int. Cl.
*E05B 37/16* (2006.01)
*E05B 9/02* (2006.01)
*E05B 65/00* (2006.01)

(52) U.S. Cl.
CPC ..... *E05B 37/16* (2013.01); *E05B 9/02* (2013.01); *E05B 65/0014* (2013.01); *E05Y 2900/20* (2013.01)

(58) Field of Classification Search
CPC ..... E05B 37/16; E05B 9/02; E05B 65/0014; E05Y 2900/20; Y10T 70/7153
USPC ..... 70/286
See application file for complete search history.

(56) References Cited

U.S. PATENT DOCUMENTS 472,868 A * 4/1892 Feret ..... E05B 37/16 70/298
530,862 A * 12/1894 Teed ..... E05C 1/04 24/654
1,308,298 A * 7/1919 Podufaly ..... E05B 37/16 70/299
1,368,556 A * 2/1921 Hill ..... E05B 37/16 70/299
2,640,346 A * 6/1953 Giffin ..... E05B 37/16 200/43.12
3,009,346 A * 11/1961 Check ..... E05B 37/16 70/214
3,023,601 A * 3/1962 Luikart ..... E05B 37/16 70/214
3,155,230 A * 11/1964 Nemsky ..... E05B 37/16 206/1.5
3,236,078 A * 2/1966 Eckardt ..... E05B 37/16 70/298

(Continued)

FOREIGN PATENT DOCUMENTS

GB 305902 A * 2/1929
GB 2343482 A * 5/2000 ..... E05B 37/16

*Primary Examiner* — Suzanne L Barrett

(57) ABSTRACT

The present utility model discloses a safety lock device including a first lock body and a second lock body. The first lock body is provided with a movable member, a first action member and a second action member. The second action member and the first action member are operated sequentially to enable the movable member to act to unlock. The first action member or the second action member is operated individually that cannot achieve the unlocking. The unlocking of the safety lock device is completed only by fitting the two moving members with each other, thereby solving the problems of the easy unlocking by children and the potential safety hazards.

16 Claims, 11 Drawing Sheets

(56) References Cited

U.S. PATENT DOCUMENTS

| | | | | | |
|---|---|---|---|---|---|
| 3,910,078 | A * | 10/1975 | Schulz | E05B 37/16 | 70/287 |
| 3,937,046 | A * | 2/1976 | Wang | E05B 37/16 | 70/315 |
| 4,671,084 | A * | 6/1987 | Lin | E05B 37/16 | 70/288 |
| 7,043,948 | B1 * | 5/2006 | Wang | E05B 37/16 | 70/299 |
| 2004/0237610 | A1 * | 12/2004 | Lee | E05B 37/16 | 70/298 |
| 2005/0210937 | A1 * | 9/2005 | Okuda | E05B 37/16 | 70/299 |

* cited by examiner

SAFETY LOCK DEVICE

TECHNICAL FIELD

The present invention relates to a safety protection device, and in particular to a safety lock device.

BACKGROUND

Currently, children can easily open or close the opening type door or the split moving door. Children generally have a weak sense of safety. The hinges on the door are usually closed automatically with a slight push by a hand, such that the children's hands are still between the door frame and the door or between the doors when the doors are opened and then closed again by the children in the case of children without any safety awareness. This makes it easy to pinch the children's hands, thus reducing the safety performance of the cabinet door. Therefore, there is an urgent need for a locking device for locking the above-mentioned types of doors.

SUMMARY

The purpose of the present invention is providing a safety lock device designed to solve the above technical shortcomings.

As the first aspect of the present invention, a safety lock device is provided, comprising a first lock body and a second lock body, wherein the first lock body is configured with a movable member, and at least a part of the movable member is fitted into a lock hole of the second lock body to lock the first lock body and the second lock body; the first lock body comprises a first action member and a second action member, the movable member comprises a first fitting member and a second fitting member, and the second fitting member comprises a first unlocking part and a second unlocking part.

The first action member is fitted with the first unlocking part so as not to drive the movable member, and the first action member is fitted with the second unlocking part so as to drive the movable member to act to unlock from the lock hole; in an initial situation, the first action member is fitted with the first unlocking part; the second action member and the first fitting member are fitted to drive the movable member to act, such that the first action member is transformed from being fitted with the first unlocking part to being fitted with the second unlocking part; and the fitting of the second action member and the first fitting member is not capable of driving the movable member to be completely separated from the lock hole, so as to prevent the second action member from directly driving the movable member to completely separate from the lock hole to unlock.

The safety lock device comprises two unlocking keys, namely a first action member and a second action member; operating the first action member individually cannot drive the movable member to act, operating the second action member individually can drive the movable member to act in the initial part of its movement stroke, and transforming the second action member from being fitted with the first unlocking member to being fitted with the second unlocking member.

Preferably, the safety lock device further comprises a third action member, and the third action member cannot drive the movable member to act; that is, the third action member and the movable member are not connected, and the third action member cannot be operated to drive the movable member. The first lock body is disposed with a positioning cavity, at least a part of the third action member is fitted into the positioning cavity, and the length of the third action member arranged in the positioning cavity is less than or equal to the depth of the positioning cavity. Obviously, when the arranged length of the third action member is less than the depth of the positioning cavity, the third action member has an operating stroke, and when the length is equal to the depth of the positioning cavity, the third action member has no operating stroke.

Preferably, the safety lock device further comprises a return device, the return device is a spring, and the two ends of the spring are respectively connected to the movable member and the first lock body to keep the movable part extending, so that the safety lock is maintained in a locked state when there is no external force.

Preferably, the first fitting member comprises a first fitting part, a lower end of the second action member is provided with a second fitting part, the second unlocking part comprises a third fitting part, and a lower end of the first action member is provided with a fourth fitting part; the first fitting part and the second fitting part are arranged in cooperation, and the third fitting part and the fourth fitting part are arranged in cooperation; at least one of the first fitting part and the second fitting part comprises an inclined surface or a curved surface, and at least one of the third fitting part and the fourth fitting part comprises an inclined surface or a curved surface. That is, the first driving mechanism formed by the fitting of the first fitting part and the second fitting part, and the second driving mechanism formed by the fitting of the third fitting part and the fourth fitting part realize the purpose of driving the movable member by pressing the action members through the fitting between the inclined surfaces or the curved surfaces, or the fitting between the cylindrical block and the inclined surface or curved surface.

And, the movable member is preferably telescopically fitted into the first lock body, and the first lock body is locked relative to the second lock body when the first lock body is extended and fitted into the lock hole. The movable member is preferably of a long strip shape, and its telescopic manner is preferably of a displacement along its length.

Preferably, at least one of the bottom of the first action member and the first unlocking part further comprises a flat surface part, so that when the first action member is fitted with the first unlocking part initially, it cannot drive the movable member due to the action of the flat surface to unlock from the lock hole.

Preferably, a first hook block is provided at a lower end of the second action member, and a second hook block is correspondingly provided on the first fitting member; after the second action member drives the movable member to act for transforming the first action member from being fitted with the first unlocking part to being fitted with the second unlocking part, the first hook block is fitted with the second hook block to limit the movable member, such that it can remain in this state after the force is applied to the second action member without the need to keep applying force; and when the first action member drives the movable member to act to unlock from the lock hole, the second hook block further moves along with the movable member, such that the first hook block is separated from the second hook block, and the second action member is reset.

Preferably, the first lock body is rotatably arranged, and wherein the safety lock device further comprises a fixed body, and a pin of the fixed body is fitted with a socket of the first lock body such that the first lock body is rotatably arranged. The rotation arrangement will change the force position of the lock head and the lock hole, and the unlocking operation mode of the safety lock; when the first lock body is directly fixed, the operation causes the movable member to retract and maintain this state and open the door body; when the first lock body is rotatably arranged, the operation causes the movable member to retract and rotate the first lock body to make the lock head and the second lock body misaligned, the door body can be opened regardless of whether the external force is removed.

Further, the first lock body and the second lock body are respectively provided with a hook body and a hook groove that are fitted, and the hook body and the hook groove are fitted to limit the relative position between the first lock body and the second lock body. When locking, it can also strengthen the locking structure of the lock bodies, which plays a locking role together with the lock head and increases the locking strength of the safety lock.

Preferably, the first lock body is further provided with a first installation cavity and a second installation cavity for at least a part of the first action member and the second action member to be arranged therein; and more preferably, the first installation cavity, the second installation cavity and the positioning cavity are provided with a return spring to keep the upper ends of the first action member, the second action member and the three action member extending from the first lock body.

As the second aspect of the present invention, another safety lock device is provided, comprising a first lock body and a movable member, wherein the movable member is telescopically fitted with the first lock body, and the safety lock device is in a locked state when at least a part of the movable member extends out of the first lock body; the first lock body further comprises a first action member and a second action member, the movable member comprises a first fitting member and a second fitting member, the second fitting member comprises a first unlocking part and a second unlocking part, and in an initial situation, the first action member is fitted with the first unlocking part.

The first action member is fitted with the first unlocking part and the second action member is fitted with the first fitting member, neither of which is capable of driving the movable member to be completely retracted into the first lock body; after the second action member is fitted with the first fitting member to drive the movable member to act for transforming the first action member from being fitted with the first unlocking part to being fitted with the second unlocking part, the first action member is fitted with the second unlocking part to drive the movable member to act to completely retract into the first lock body, and thus the safety lock device is transformed into an unlocked state.

At least a part of the above-mentioned movable member extends from the first lock body and the movable member is completely retracted into the first lock body, which are not limited to the fact that the movable member needs to be arranged inside the first lock body and extends from or retracts into the first lock body, and further comprises the upper and lower layered fitting relationship, thus the movable member extends or contracts to pass over the edge of the first lock body. Both of these two methods can realize the locking and unlocking of the safety lock device. In addition, the above-mentioned telescopic arrangement is not limited to reciprocating movement along the linear telescopic path, and further comprises the rotary arrangement of the arc-shaped movable member along its rotation center.

Preferably, the movable member is of long strip shape and telescopically disposed on the first lock body along its length. The fitting between the first action member and the first fitting member, and the fitting between the second action member and the first unlocking part or the second unlocking part are achieved through a driving mechanism; and the driving mechanism comprises a first driving member and a second driving member, and at least one of the first driving member and the second driving member comprises an inclined surface or a curved surface. That is, there may be two inclined surfaces or curved surfaces that are fitted with each other, or a driving block is fitted with another inclined surface or curved surface.

Preferably, the first lock body further comprises a third action member which is not capable of driving the movable member to completely retract into the first lock body. That is, the third action member may be completely unable to drive the movable member, or the third action member is fitted with the movable member to drive its movement but cannot drive the movable member to fully retract into the first lock body to unlock the safety lock device. The addition of the third action member can further increase the number of optional operations allowed by the safety lock device, and reduce the risk of the possible opening when the user does not understand the operation method of the safety lock device, or when a child with immature thinking makes a mistake.

In the safety lock device designed by the present invention, in terms of its structure, after pressing an action member to move down, only the lock head of the movable member is initially retracted, but is still in the locked state, and then after another action member is pressed to move down, the lock head of the movable member is completely retracted, such that the unlocking operation can be completed. The safety lock device solves the technical problems that the existing locking device may be easy for children to unlock and thus the door is easier to open due to the children's learning and imitating or the mis-operation during the play in the actual use, thereby causing potential safety hazards. Therefore, the safety lock device in the invention achieves the technical effect that it is not easy for children to unlock and the door is not easily opened, thereby eliminating potential safety hazards. The addition of a third action member with no practical effect can further reduce the possibility of learning and imitating or mis-operation to open the safety lock device, which significantly improves safety.

DETAIL DESCRIPTION OF THE EMBODIMENTS

Figure 1:
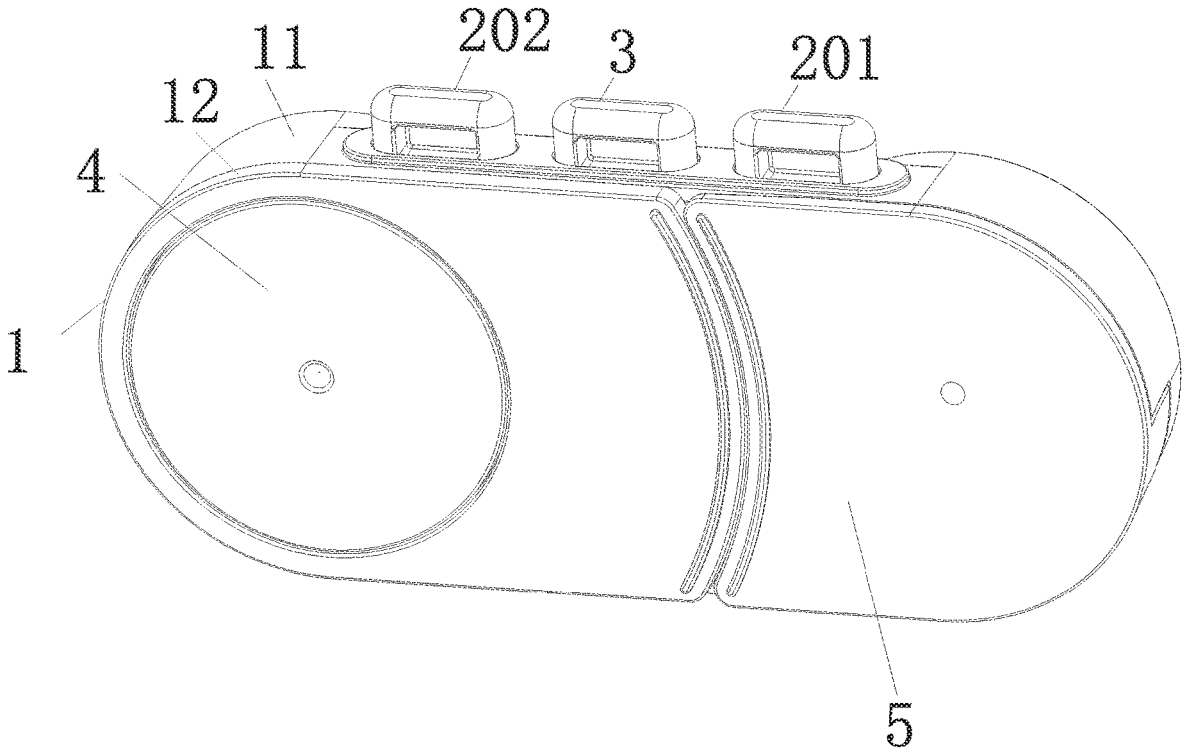
FIG. 1 is a schematic diagram of the overall structure of Embodiment 1.
Figure 2:
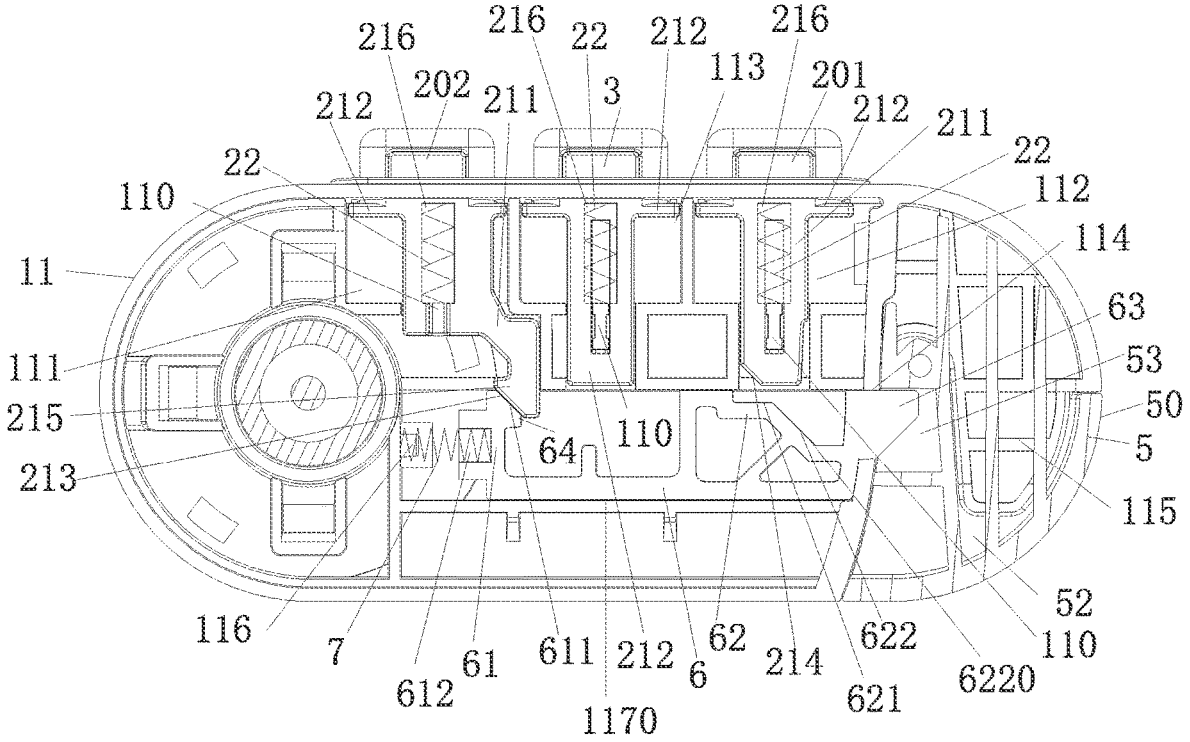
FIG. 2 is a cross-sectional view of Embodiment 1.
Figure 3:
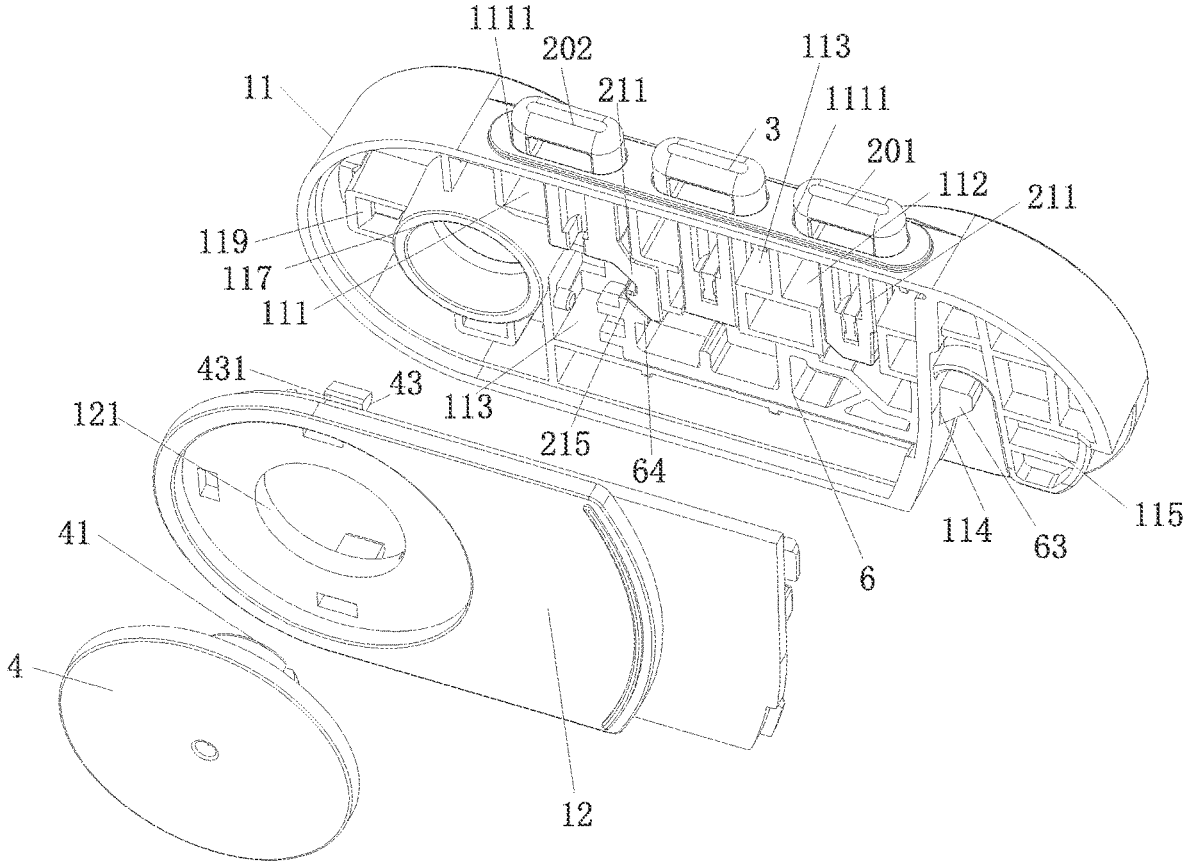
FIG. 3 is an exploded view of Embodiment 1.
Figure 4:
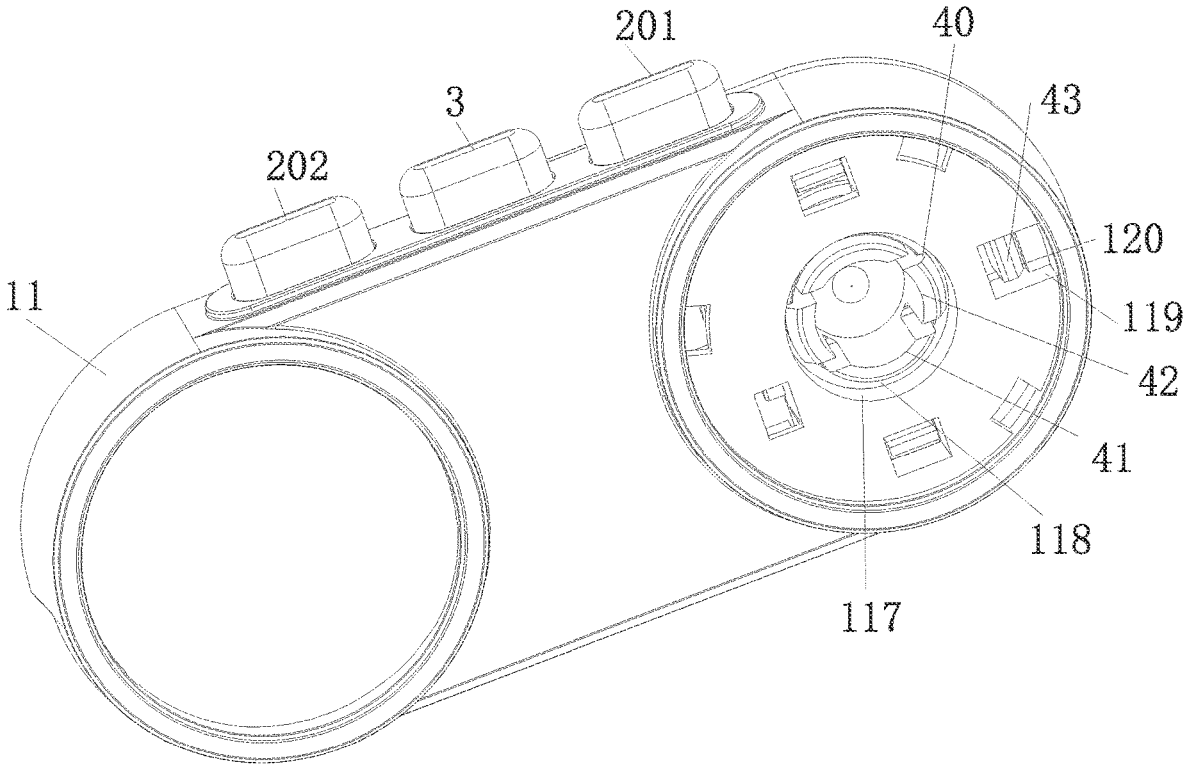
FIG. 4 is an assembly view of Embodiment 1.
Figure 5:
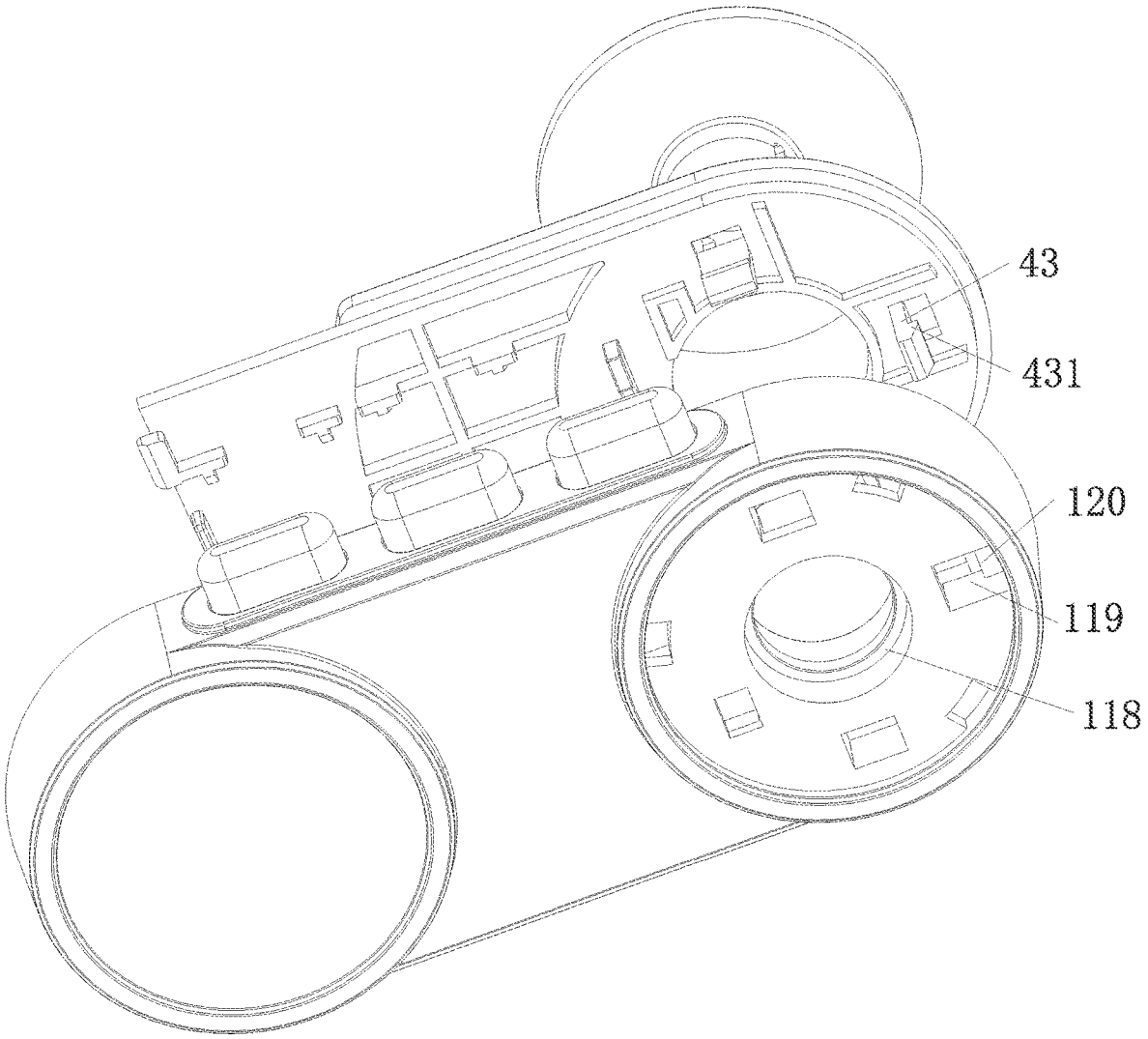
FIG. 5 is an exploded view of Embodiment 1.
Figure 6:
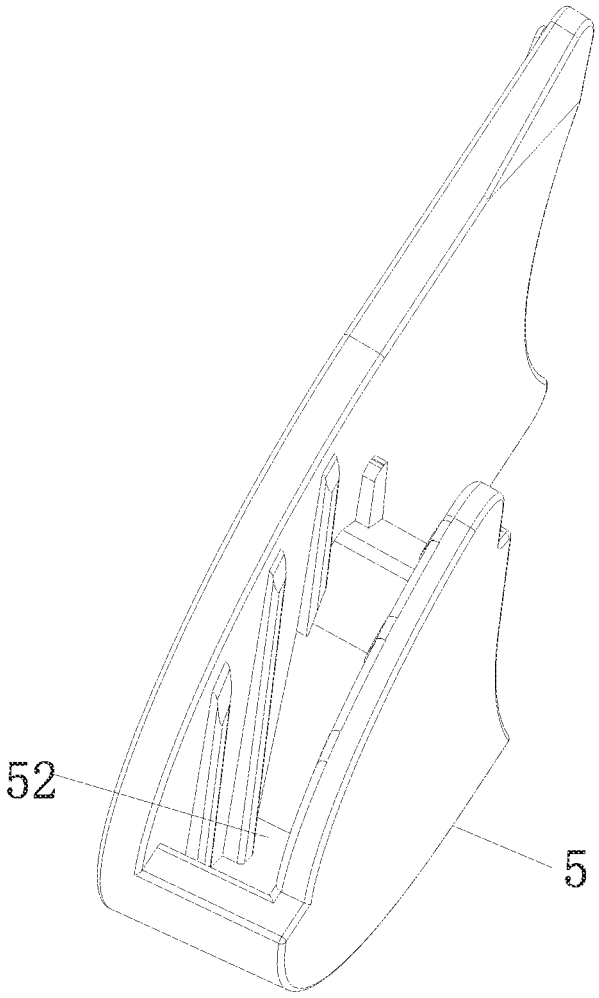
FIG. 6 is a schematic diagram of the structure of the hook and sleeve of embodiment 1.

The technical solutions in the embodiments of the present invention will be clearly and completely described below in conjunction with the accompanying drawings in the embodiments of the present invention. Obviously, the described embodiments are only a part of the embodiments of the present invention, rather than all the embodiments. Based on the embodiments of the present invention, all other embodiments obtained by those of ordinary skill in the art fall within the protection scope of the present invention.

Embodiment 1

As shown in FIGS. 1-6, the safety lock device described in the present application comprises a first lock body 1 and a second lock body 50, wherein the first lock body is configured with a movable member 6, and a lock head 63 at one end of the movable member 6 extends from one side of the first lock body 1 and is inserted into the lock hole 53 of the second lock body 50 to lock the first lock body 1 and the second lock body 50.

The first lock body 1 is configured with a first action member 201 and a second action member 202, and the movable member 6 is disposed with a first fitting member 61 and a second fitting member 62 that are fitted with the second action member 202 and the first action member 201, respectively. The second fitting member 62 further comprises a first unlocking part 621 and a second unlocking part 622. The first action member 201 is fitted with the first unlocking part 621 so as not to drive the movable member 6 to unlock from the lock hole 53, and the first action member 201 is fitted with the second unlocking part 622 so as to drive the movable member 6 to act to unlock from the lock hole 53; and in an initial situation (that is, when there is no external force, the same below), the first action member 201 is fitted with the first unlocking part 621. The second action member 202 and the first fitting member 61 are fitted to drive the movable member 6 to act, such that the first action member 201 is transformed from being fitted with the first unlocking part 621 to being fitted with the second unlocking part 622. The fitting of the second action member 202 and the first fitting member 61 is not capable of driving the movable member 6 to act to be completely separated from the lock hole 53, but can drive the movable member 6 to act to achieve the above-mentioned fitting transformation; that is, the fitting between the second action member 202 and the first fitting member 61 can only drive the movable member 6 to make partial displacement but not all displacement within its movable stroke range.

Therefore, in the initial situation of the safety lock device, operating the first action member 201 individually has no substantial effect. When the second action member 202 is operated individually, the movable member 6 can be driven to complete the transition of the first action member 201 from the state of being engaged with the first unlocking part 621 to the state of being engaged with the second unlocking part 622, and cannot drive the movable member 6 to be completely separated from the lock hole 53 to unlock the first lock body 1 and the second lock body 50. When unlocking, firstly operating the second action member 202 to achieve the above transition, and then operating the first action member 201 can drive the movable member 6 to be completely separated from the lock hole 53 to unlock the first lock body 1 and the second lock body 50.

It should be noted that the first action member 201 does not have a substantial effect when operated individually, and it has two status: completely unresponsive or has a certain idle stroke, as long as its operation does not actually drive the movable member 6 in the end, for example: the first action member 201 is against the movable member 6 but cannot be pressed, the movable member 6 is provided with a concave block or the length of the first action member 201 is reduced to allow it to have a pressing stroke.

Preferably, the movable member 6 is of long strip shape, and is telescopically fitted into the first lock body 1 along its length; when the lock head 63 of the movable member is extended and fitted into the lock hole 53, the first lock body 1 is locked relative to the second lock body 50. In order to make the displacement and movement of the movable member 6 more stable and improve the performance, the side wall of the inner cavity of the first lock body 1 is provided with an elongated cavity 1170 for positioning the movable member 6, and the two ends of the spring 7 respectively abut against the tail end of the movable member 6 and the side wall of the tail end of the elongated cavity 1170 to keep the movable member 6 extending out. The tail end of the elongated cavity 1170 is also provided with a positioning post 116, the tail of the movable member 6 is provided with a positioning sleeve 612, and a spring 7 is sleeved on the positioning post 116, and the end of the spring 7 is positioned in the positioning sleeve 612, such that a stable positioning can be obtained after the spring 7 is installed.

In a preferred situation, the first fitting member 61 comprises a first fitting part 611; the lower end of the second action member 202 is provided with a second fitting part 213; the second unlocking part 622 comprises a third fitting part 6220; a fourth fitting part 214 is provided at the lower end of the first action member 201; the first fitting part 611 and the second fitting part 213 are provided in cooperation; and the third fitting part 6220 and the fourth fitting part 214 are provided in cooperation. At least one of the first fitting part 611 and the second fitting part 213 comprises an inclined surface or a curved surface, and at least one of the third fitting part 6220 and the fourth fitting part 214 comprises an inclined surface or a curved surface. Therefore, it is realized that the first action members 201 and the second action members 202 can drive the movable member 6 to be telescopically fitted in the first lock body 1 under corresponding conditions.

Obviously, the fitting between two inclined surfaces or two curved surfaces, as well as the fitting between a block structure and an inclined surface or curved surface, can achieve the above-mentioned purpose of drive fit; when the block structure is adopted, the edges and corners may increase the resistance, thus it can be chamfered or rounded (at this time, it can also be regarded as the fitting between two inclined surfaces or curved surfaces).

Based on the foregoing, the first lock body 1 may comprises a lock shell 11 and a cover plate 12 covering the opening of the lock shell 11. A plurality of buckle holes 119 are provided on the lock shell 11, and a plurality of buckle plates are provided on the inner side of the cover plate 12. After each buckle plate 43 is inserted into the buckle hole 119 correspondingly, the buckle block 431 of the buckle plate 43 is buckled on the buckle block 120 of the buckle hole 119. The cover plate 12 is provided with a positioning hole 121 corresponding to the position of the insertion hole 117 on the lock shell 11, a through hole 114 for the lock head 63 to penetrate is provided at one end of the lock shell 11, and the hook 115 is located at one end of the lock shell 11 with the through hole 114. Therefore, the first installation cavity 111 and the second installation cavity 112 are respectively provided on the inner side wall of the lock shell 11 and located above the elongated cavity 1170. Both the first action member 201 and the second action member 202 comprise a return spring 22; the inner cavity of the first lock body 1 is divided by a partition to form a first installation cavity 111 and a second installation cavity 112 in which at least a part of the first action member 201 and the second action member 202 are respectively arranged, an installation hole 1111 is provided on the first lock body 1 at positions corresponding to the two installation cavities, the top of the positioning rod 211 of the first action member 201 and the top of the positioning rod 211 of the second action member 202 respectively penetrate the two installation holes 1111; the positioning rod 211 of the first action member 201 and the positioning rod 211 of the second action member 202 are placed in the two installation cavities, and the positioning rod 211 of the first action member 201 and the positioning rod 211 of the second action member 202 respectively penetrate the two installation cavities; the lower end of the positioning rod 211 of the first action member 201 and the lower end of the positioning rod 211 of the second action member 202 are respectively provided with inclined surfaces to serve as the fourth fitting part 214 and the second fitting part 213; both the positioning rod 211 of the first action member 201 and the positioning rod 211 of the second action member 202 are provided with an elongated hole 216; the positioning blocks 110 on the side walls of the two installation cavities are inserted into the elongated holes 216, and the top side walls of the elongated holes 216 and the positioning blocks 110 abut and contact with a return spring 22, the return spring 22 is provided on the first action member 201 and the second action member 202 to realize that the action members can automatically move up and reset after the action members move down.

However, the safety lock device can also be provided with a third action member 3. The inner cavity of the first lock body 1 is separated by a partition to form with a positioning cavity 113 in which at least a part of the third action member 3 is arranged. The positioning rod 211 of the action member 3 is placed in the positioning cavity 113; the top of the positioning rod 211 of the third action member 3 is provided with a tab 212; the positioning rod 211 of the third action member is provided with an elongated hole 216, and the positioning block 110 on the side wall of the positioning cavity 113 is inserted into the elongated hole 216, and the top side wall of the elongated hole 216 and the positioning block 110 abut and contact with the return spring; and the positioning rod 211 penetrates the positioning cavity 113. The action parts of the third action member 3 extend from the through hole of the positioning cavity, and the length of the part of the third action member 3 provided in the positioning cavity 113 is less than or equal to the depth of the positioning cavity 113. The third action member 3 is an action member with no actual function, and it has no direct or indirect connection relationship with the movable member 6, and there will be no other actual effect after the third action member 3 is operated. Therefore, in the initial locked state, after the third action member 3 is pressed down for a proper distance, it has no substantial effect, so as to achieve the technical effect that children cannot open the locking device. Because the lock body comprises the lock shell and the cover plate, the positioning cavity is also arranged on the side wall of the inner cavity of the lock shell, located above the elongated cavity, so that operating the third action member 3 individually cannot achieve the unlocking purpose.

In this embodiment, a first hook block 215 is also provided at the lower end of the positioning rod 211 of the second action member 202, and a second hook block 64 is provided at the top end of the first fitting part 61 of the movable member 6, and meanwhile, the two inclined surfaces which serve as the first fitting part 611 and the second fitting part 213 are respectively arranged on the first hook block 215 and the second hook block 64. After the second action member 202 drives the movable member 6 to transform the first action member 201 from being fitted with the first unlocking part 621 to being fitted with the second unlocking part 622, the first hook block 215 and the second hook block 64 are fitted to limit the movable member 6 to keep the movable member 6 in this state without continuously applying force to the second action member 202; and when the first action member 201 drives the movable member 6 to further move and unlock from the lock hole 53, the second hook block 64 is correspondingly displaced to separate the first hook block 215 from the second hook block, and the second action member 202 is reset.

In this embodiment, a fixed body 4 is further included. The pin 41 of the fixed body 4 penetrates the positioning hole 121 on the cover plate 12 and then is rotatably connected with the socket 117 of the lock shell 11; the pin 41 is provided with an elastic sheet 42, and a limit block 40 is provided on the elastic sheet 42; and a step 118 is provided inside the insertion hole 117 of the lock shell 11, so that the limit block is limited on the step to complete the rotary installation. Meanwhile, the first lock body 1 and the second lock body 50 are respectively provided with a hook body 115 and a hook groove 52 that are fitted with each other. The hook sleeve 5 fitted with the hook body 115 is used to fix the fixed body 4 to a door panel by glue. The hook sleeve 5 is fixed on the other door panel by glue. When locking, the lock body is rotated so that the hook body 115 is inserted into the hook groove 52, and the lock head 63 is correspondingly inserted into the lock hole 53 to complete the locking of the split door. After unlocking, the first lock body 1 is pushed upward to rotate at the same time, so that the hook body 115 of the first lock body 1 is detached from the hook groove 52 of the hook sleeve 5 to complete the unlocking and opening.

Embodiment 2

Figure 7:
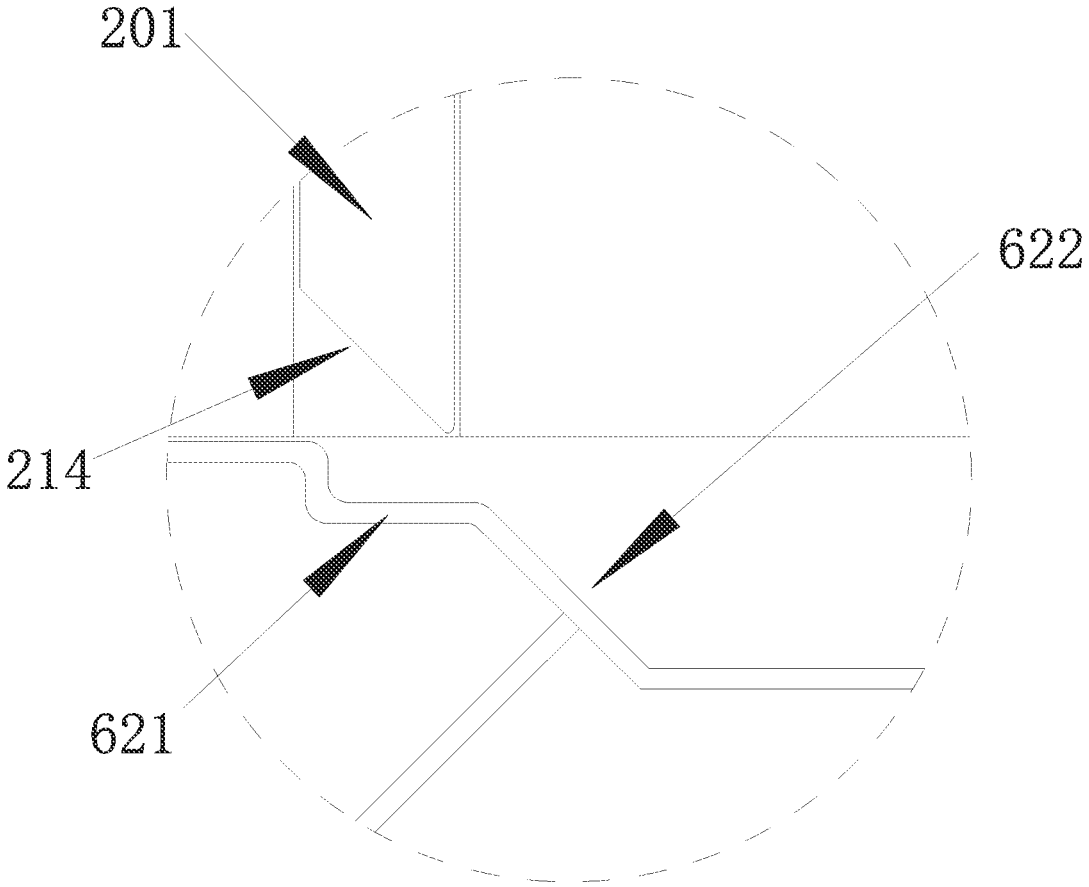
FIG. 7 is a schematic diagram of the fitting between the first action member and the movable member in another embodiment of the present invention.

The safety lock device described in this embodiment is generally the same as that in Embodiment 1, except that:

as shown in FIG. 7, the bottom of the first action member 201 is an inclined surface part, and the first unlocking part 621 is configured as a flat surface part. After a force is applied to the first action member 201, since the first unlocking part 621 is composed of the flat surface part, the first action member 201 cannot drive the movable member 6 to unlock from the lock hole 53 at this time (that is, in the initial situation).

Embodiment 3

Figure 8A:
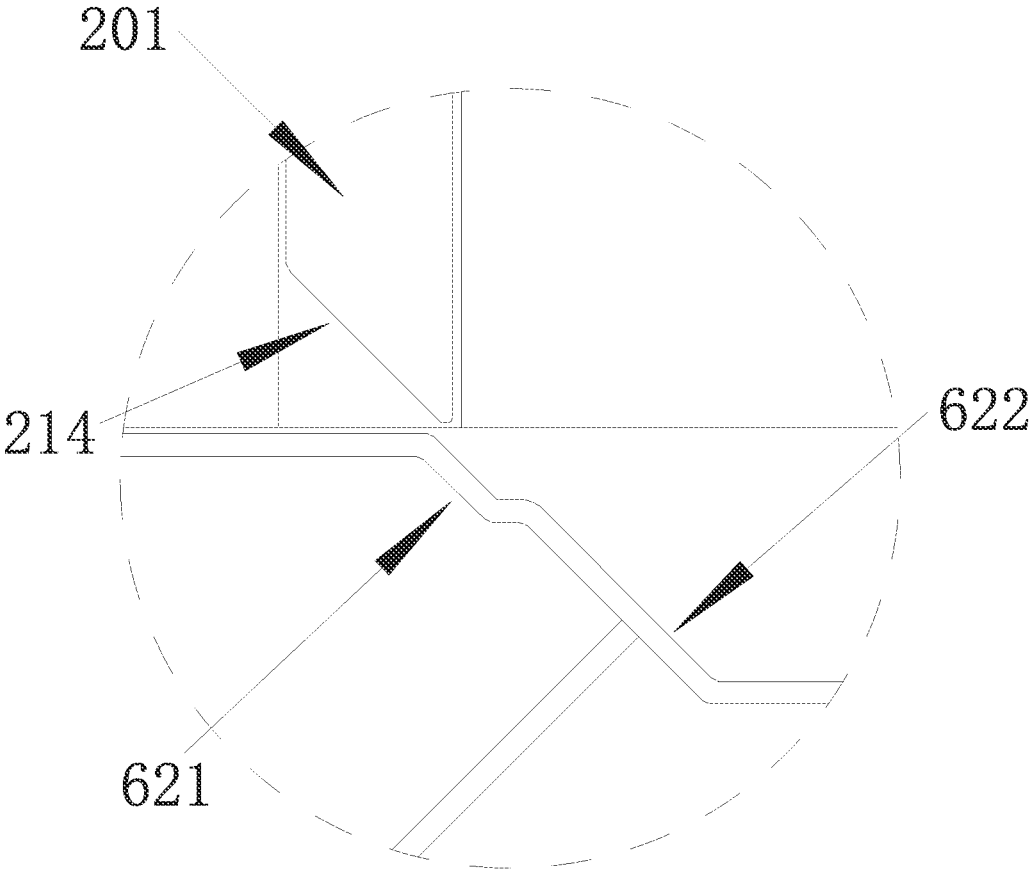
FIGS. 8*a* and 8*c* are the schematic diagrams of the initial fitting of the first action member and the movable member in other embodiments of the present invention, respectively.
Figure 8B:
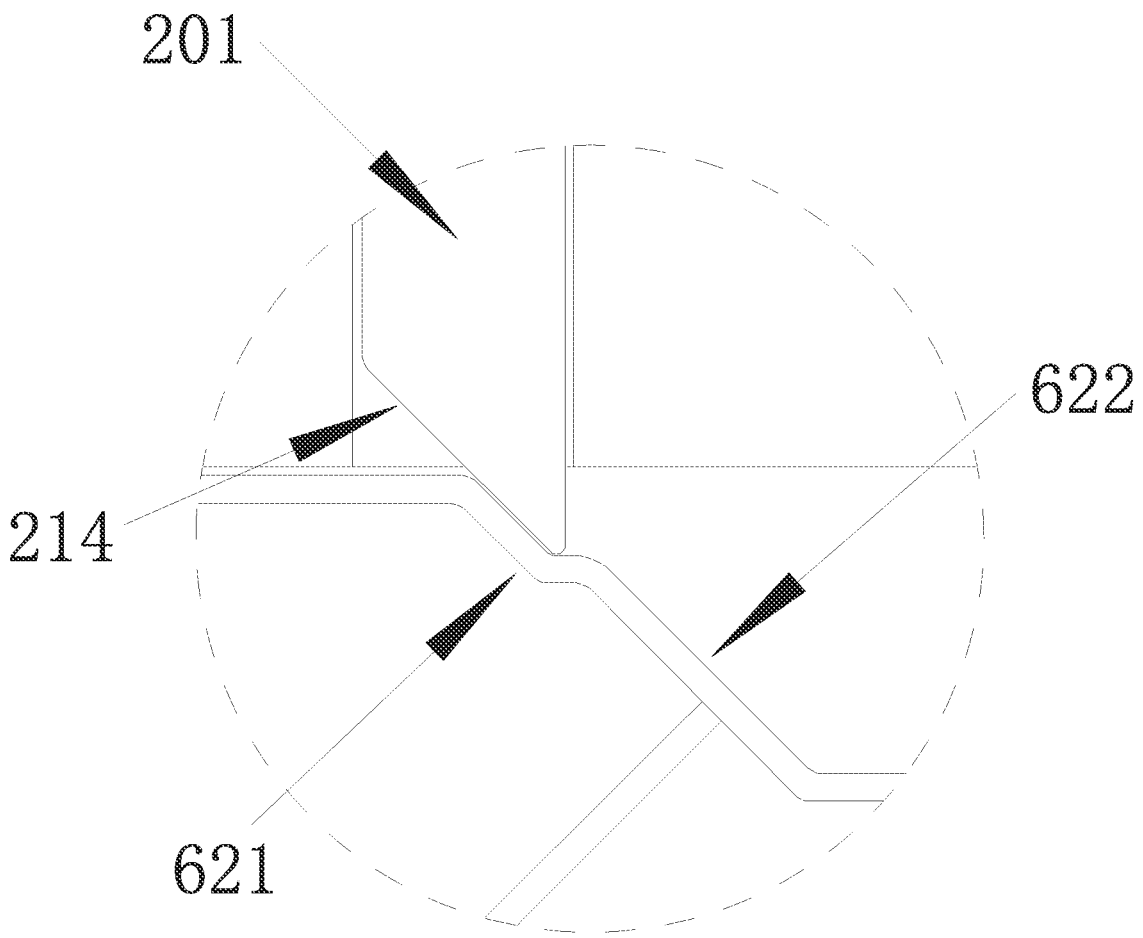
FIGS. 8*b* and 8*d* are the schematic diagrams of the fitting in FIGS. 8*a* and 8*c* respectively after the first action member is stressed.
Figure 8C:
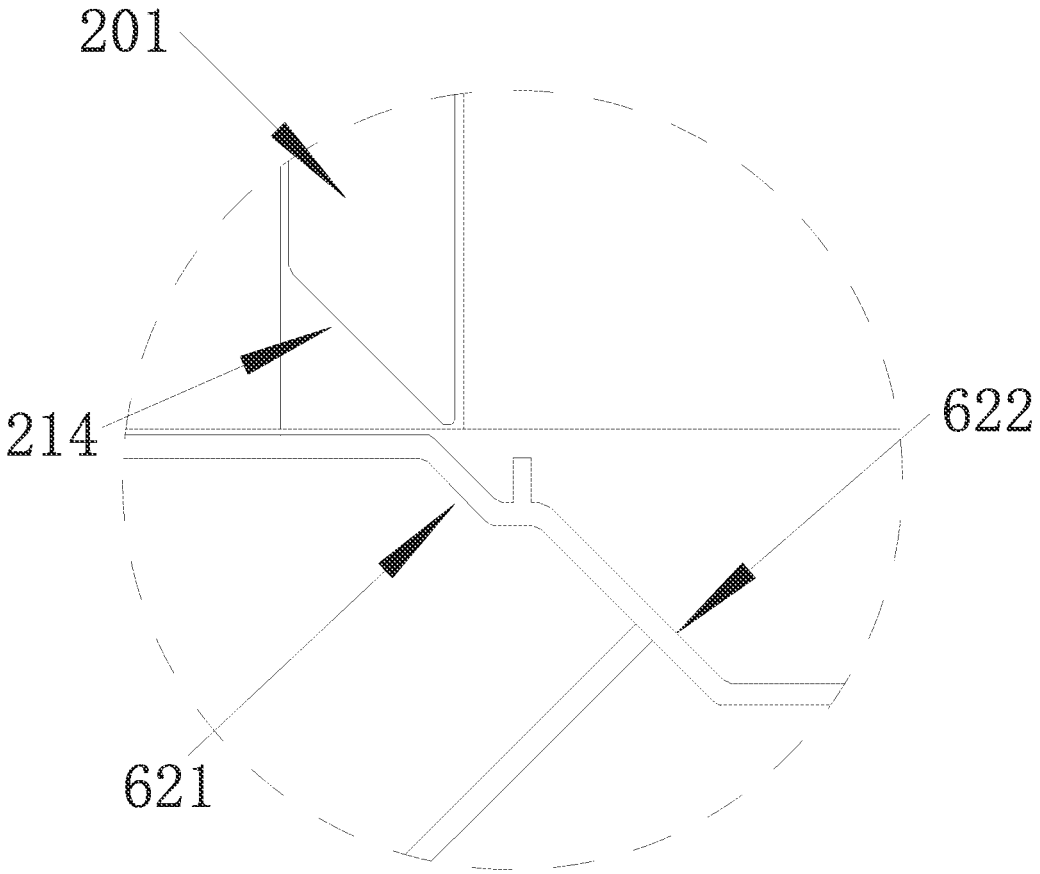
Figure 8D:
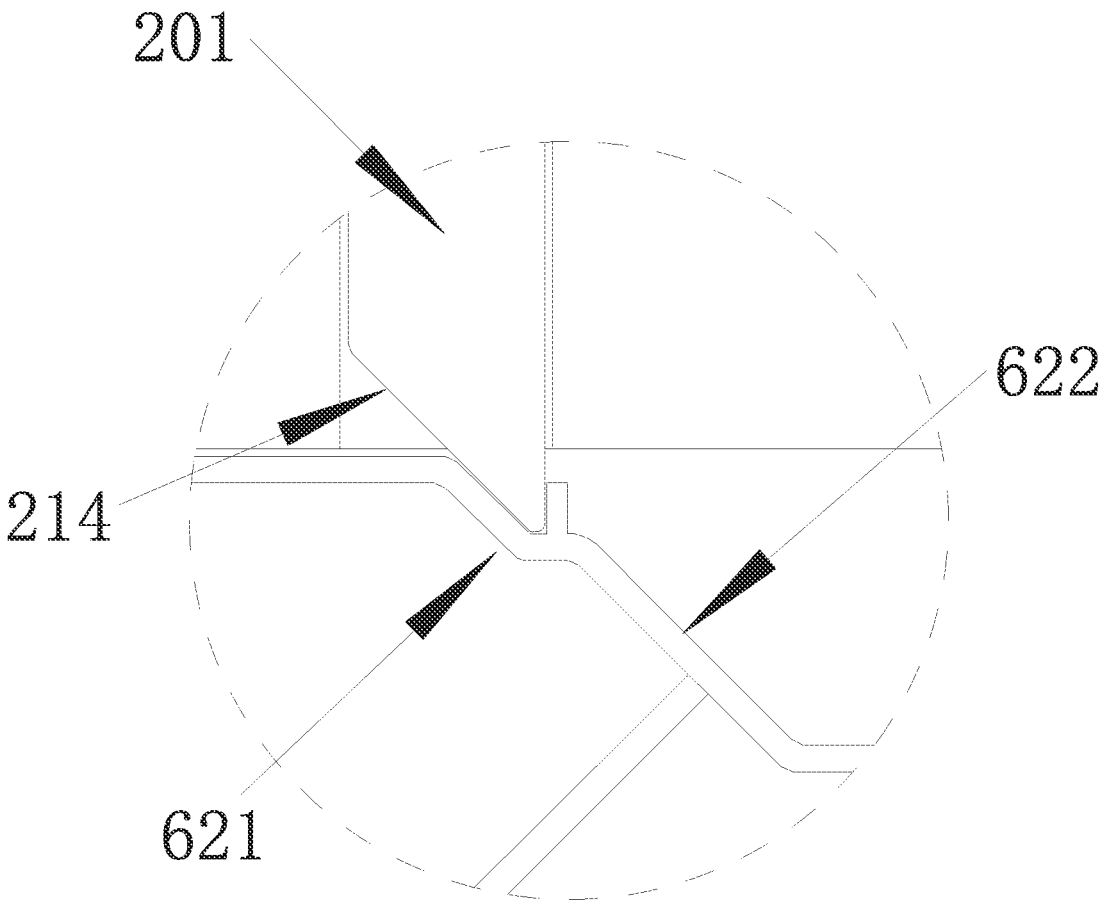

The safety lock device described in this embodiment is generally the same as that in Embodiment 1, except that:

as shown in FIG. 8*a*. 8*b*, the first unlocking part 621 is configured to be composed of an inclined surface part and a partition part. The inclined surface part is discontinuous and separated from the second unlocking part 622. The partition part can separate the inclined surface part of the first unlocking part 621 and the second unlocking part 622 which is a flat surface or a vertical surface. Operating the first action member 201 individually can cause the movable member to produce partial displacement under the action of the inclined surface (not enough to unlock the movable member 6 from the lock hole 53); and, after the second action member 202 and the first fitting member 61 are fitted, the movable part 6 is driven to act accordingly, so that the first action part 201 can be transformed from being fitted with the first unlocking part 621 to being fitted with the second unlocking part 622. Specifically, it can be achieved by adjusting the position and size relationship of each part, so that operating the first action member 201 individually cannot drive the movable member 6 to unlock from the lock hole 53.

Embodiment 4

The safety lock device described in this embodiment is generally the same as that in Embodiment 1, except that:

The third action member 3 and the movable member 6 are also fitted by a driving mechanism. The driving mechanism comprises a first driving member and a second driving member. At least one of the first driving member and the second driving member is an inclined surface or a curved surface. The specific structure can refer to the fitting relationship between the second action member 202 and the movable member 6. Moreover, the third action member 3 can only drive the movable member 6 to make a partial displacement along its movement stroke (partial displacement refers to the displacement of the unlocking stroke relative to the movable member 6), but cannot drive it to be completely unlocked from the lock hole 53.

At this time, the functions of the third action member 3 and the second action member 202 will have a certain similarity. For this reason, the fitting relationship between the third action member 3 and the movable member 6 can be configured so that the first action member 201 is still fitted with the first unlocking part 621 after the third action member 3 drives the movable member 6 to displace. That is, operating the third action member 3 does not transform the first action member 201 from being fitted with the first unlocking part 621 to being fitted with the second unlocking part 622.

In this embodiment, operating the third action member 3 can drive a partial displacement action of the movable member 6 (partial displacement refers to the displacement of the unlocking stroke relative to the movable member 6), but it does not actually play any substantial role.

The operation method of the safety lock device of any of the above embodiments mainly comprises the following steps:

S1. configuring a movable member on a first lock body, wherein the movable member is preferably telescopically fitted into the first lock body, and when at least a part of the movable member extends out of the first lock body, the safety lock device is in a locked state.

The relative positional relationship between the movable member and the first lock body comprises: the movable member is arranged in the first lock body, and the movable member and the first lock body are in an upper and lower layered relative positional relationship. When the movable member is located in the first lock body, it can be fully retracted into the first lock body, and when the movable member and the first lock body are arranged in a layered position, any part of the movable member will not exceed the edge of the first lock body after the contraction.

S2: configuring a first action member and a second action member on the first lock body, configuring a first fitting member and a second fitting member on the movable member, and configuring a first unlocking part and a second unlocking part on the second fitting member; wherein in the initial situation, the first action member is fitted with the first unlocking part.

S3: operating the second action member to drive the movable member to act through the fitting of the first fitting member of the movable member, so that the first action member is transformed from initially being fitted with the first unlocking part to being fitted with the second unlocking part; after the transformation, when the first action member is fitted with the second unlocking part, the movable member is in the initial unlock state. That is, operating the second action member can make the movable member perform partial displacement within its complete range of movement stroke, more specifically the front displacement, so that the fitting state of the first action member and the second matching member is changed.

S4: While maintaining the operation of S3, operating the first action member to drive the movable member to move further through the fitting of the second unlocking member, and the movable member is completely withdrawn from the lock hole to unlock, completing the unlocking process of the first lock body relative to the second lock body.

In addition, the control method can also perform corresponding control based on the relevant structure and operation mode of the foregoing embodiment.

The present invention is not limited to the above-mentioned best embodiments. Anyone can obtain other products in various forms under the enlightenment of this invention. However, regardless of any changes in its shape or structure, any technical solutions that are the same or similar to those of the present application fall within the protection scope of the present invention.

The invention claimed is:

1. A safety lock device, comprising: a first lock body, a second lock body, and a movable member, the movable member being telescopically disposed on the first lock body, and at least a part of the movable member being disposed in a lock hole of the second lock body to lock the first lock body and the second lock body when the movable member extends out;

wherein the first lock body comprises a first action member and a second action member, and the movable member comprises a first fitting member and a second fitting member, and the second fitting member comprises a first unlocking part and a second unlocking part;

the first action member acts on the first unlocking part so as not to drive the movable member, the first action member acts on the second unlocking part so as to drive the movable member to act to unlock from the lock hole, and the second action member acts on the first fitting member so as not to drive the movable member to be completely separated from the lock hole;

in an initial situation, the first action member is located at a position corresponding to the first unlocking part; and when unlocking, the second action member acts on the first fitting member to drive the movable member to act, such that the first action member is transformed from corresponding to the first unlocking part to corresponding to the second unlocking part, and the first action member acts on the second unlocking part so as to drive the movable member to act to unlock from the lock hole.

2. The safety lock device according to claim 1, further comprising a third action member that is not capable of driving the movable member to act, wherein the first lock body is disposed with a positioning cavity, and at least a part of the third action member is fitted into the positioning cavity, and the length of the third action member arranged in the positioning cavity is less than or equal to the depth of the positioning cavity.

3. The safety lock device according to claim 1, wherein, the first fitting member comprises a first fitting part, a lower end of the second action member is provided with a second fitting part, the second unlocking part, comprises a third fitting part, and a lower end of the first action member is provided with a fourth fitting part; the first fitting part is positioned corresponding to the second fitting part, and the third fitting part is positioned corresponding to and the fourth fitting part;

at least one of the first fitting part and the second fitting part is an inclined surface or a curved surface, and at least one of the third fitting part and the fourth fitting part is an inclined surface or a curved surface; the movable member is telescopically disposed in the first lock body, and when a front end thereof extend into the lock hole, the first lock body is locked relative to the second lock body.

4. The safety lock device according to claim 1, further comprising a return device, wherein the return device is a spring, and both ends of the spring are connected to the movable member and the first lock body respectively, to keep the movable member extending.

5. The safety lock device according to claim 1, wherein, the fitting of the second action member and the first fitting member is not capable of driving the movable member to act, or is capable of driving the movable member to act but is not capable of completely separating the movable member from the lock hole, such that operating the second action member alone cannot unlock the safety lock device.

6. The safety lock device according to claim 1, wherein, at least one of a bottom of the first action member and the first unlocking part has a flat surface, such that the first action member acts on the first unlocking part in the initial situation so as not to drive the movable member to act to unlock from the lock hole.

7. The safety lock device according to claim 3, wherein, at least one of a bottom of the first action member and the first unlocking part comprises a flat surface, such that the first action member acts on the first unlocking part in the initial situation so as not to drive the movable member to act to unlock from the lock hole.

8. The safety lock device according to claim 1, wherein, a first hook block is provided at a lower end of the second action member, and a second hook block is correspondingly provided on the first fitting member; after the second action member drives the movable member to act for transforming the first action member from being fitted with the first unlocking part to being fitted with the second unlocking part, the first hook block is buckled with the second hook block to limit the movable member, and when the first action member drives the movable member to act to unlock from the lock hole, the first hook block is separated from the second hook block.

9. The safety lock device according to claim 4, wherein, a first hook block is provided at a lower end of the second action member, and a second hook block is correspondingly provided on the first fitting member; after the second action member drives the movable member to act for transforming the first action member from being fitted with the first unlocking part to being fitted with the second unlocking part, the first hook block is buckled with the second hook block to limit the movable member, and when the first action member drives the movable member to act to unlock from the lock hole, the first hook block is separated from the second hook block.

10. The safety lock device according to claim 1, wherein, the first lock body is rotatably arranged, and wherein the safety lock device further comprises a fixed body, and a pin of the fixed body is inserted into a socket of the first lock body so that the first lock body is rotatably arranged.

11. The safety lock device according to claim 9, wherein, the first lock body is rotatably arranged, and wherein the safety lock device further comprises a fixed body, and a pin of the fixed body is inserted into a socket of the first lock body so that the first lock body is rotatably arranged.

12. The safety lock device according to claim 10, wherein, the first lock body and the second lock body are respectively provided with a hook body and a hook groove that are buckled with each other.

13. The safety lock device according to claim 2, wherein, the first lock body is further provided with a first installation cavity and a second installation cavity for at least a part of the first action member and the second action member to be arranged therein, and the first installation cavity, the second installation cavity and the positioning cavity are provided with a return spring to keep the upper ends of the first action member, the second action member and the three action member extending from the first lock body.

14. A safety lock device comprising a first lock body and a movable member, wherein the movable member is telescopically fitted on the first lock body, and the safety lock device is in a locked state when at least a part of the movable member extends out of the first lock body, the first lock body further comprises a first action member and a second action member, the movable member comprises a first fitting member and a second fitting member, the second fitting member comprises a first unlocking part and a second unlocking part, and in an initial situation, the first action member is positioned corresponding to the first unlocking part;

the first action member acts on the first unlocking part and the second action member acts on the first fitting member, neither of which is capable of driving the movable member to be completely retracted into the first lock body; the second action member acts on the first fitting member to drive the movable member to act for transforming the first action member from corresponding to the first unlocking part to corresponding to the second unlocking part, the first action member acts on the second unlocking part to drive the movable member to act to completely retract into the first lock body, and thus the safety lock device is transformed into an unlocked state.

15. The safety lock device according to claim 14, wherein, the movable member is telescopically disposed on the first lock body along its length, and the fitting between the first action member and the first fitting member-, and the fitting between the second action member and the first unlocking part or the second unlocking part are achieved through a driving mechanism; and the driving mechanism comprises a first driving member and a second driving member, and at least one of the first driving member and the second driving member comprises an inclined surface or a curved surface.

16. The safety lock device according to claim 14, wherein, the first lock body further comprises a third action member, and the third action member is not capable of driving the movable member to completely retract into the first lock body.

* * * * *